US008398825B2

(12) United States Patent
Adams et al.

(10) Patent No.: US 8,398,825 B2
(45) Date of Patent: Mar. 19, 2013

(54) REMOTELY-OPERATED MODE SHIFTING APPARATUS FOR A COMBINATION FLUID JET DECOKING TOOL, AND A TOOL INCORPORATING SAME

(75) Inventors: Douglas Adams, Fullerton, CA (US); Lloyd D. Hanson, Long Beach, CA (US); Andrew Worley, Los Angeles, CA (US)

(73) Assignee: Flowserve Management Company, Irving, TX (US)

( * ) Notice: Subject to any disclaimer, the term of this patent is extended or adjusted under 35 U.S.C. 154(b) by 445 days.

(21) Appl. No.: 12/772,410

(22) Filed: May 3, 2010

(65) Prior Publication Data

US 2010/0276504 A1 Nov. 4, 2010

Related U.S. Application Data

(60) Provisional application No. 61/175,260, filed on May 4, 2009.

(51) Int. Cl.
*B01D 3/00* (2006.01)
*B23B 51/06* (2006.01)

(52) U.S. Cl. ..... 202/241; 202/262; 202/239; 202/268; 239/446

(58) Field of Classification Search ..... 202/241, 202/239, 262, 268; 239/446
See application file for complete search history.

(56) References Cited

U.S. PATENT DOCUMENTS

| | | | | |
|---|---|---|---|---|
| 4,275,842 | A | 6/1981 | Purton et al. | |
| 4,611,613 | A | 9/1986 | Kaplan | |
| 4,738,399 | A * | 4/1988 | Adams | 239/447 |
| 4,828,651 | A | 5/1989 | Lumbroso et al. | |
| 4,923,021 | A | 5/1990 | Courmier et al. | |
| 5,794,729 | A | 8/1998 | Van Meter et al. | |
| 5,816,505 | A | 10/1998 | Tran et al. | |
| 5,855,742 | A | 1/1999 | Lumbroso et al. | |
| 6,644,567 | B1 * | 11/2003 | Adams et al. | 239/566 |
| 7,117,959 | B2 | 10/2006 | Lah | |
| 7,163,165 | B2 * | 1/2007 | Paul et al. | 241/39 |
| 7,473,337 | B2 * | 1/2009 | Lah | 202/239 |
| 8,074,745 | B2 * | 12/2011 | Paul et al. | 175/317 |
| 8,197,644 | B2 * | 6/2012 | Lah | 201/2 |
| 2008/0296405 | A1 | 12/2008 | Hanson et al. | |

FOREIGN PATENT DOCUMENTS

WO WO9310380 A1 5/1993

OTHER PUBLICATIONS

Partial International Search Report dated Sep. 27, 2010, PCT Appln. No. PCT/US2010/033470, Flowserve Management Company.

* cited by examiner

*Primary Examiner* — Nina Bhat
(74) *Attorney, Agent, or Firm* — Dinsmore & Shohl LLP

(57) ABSTRACT

A mode shifting apparatus for a decoking tool, a decoking tool and method of operating same. The apparatus includes features to make it rotatably and translationally responsive to changes in pressure of a decoking fluid such that the apparatus is cooperative with the tool and the decoking fluid in a first operating condition to establish a drilling mode with one or more of the tool's drilling nozzles, and in a second operating condition to establish a cutting mode with one or more of the tool's cutting nozzles. In one form, the apparatus includes one or more sets of tandem seals disposed along a component interface within the apparatus or between the apparatus and the tool to help redundantly isolate seizure-sensitive components within the apparatus from the pressurized decoking fluid. In another form, the apparatus includes a gas spring to counteract the forces imposed by the pressurized decoking fluid. In another form, the apparatus includes a manual override connection.

23 Claims, 5 Drawing Sheets

REMOTELY-OPERATED MODE SHIFTING APPARATUS FOR A COMBINATION FLUID JET DECOKING TOOL, AND A TOOL INCORPORATING SAME

This application claims the benefit of the filing date of U.S. Provisional Application No. 61/175,260, filed May 4, 2009.

BACKGROUND OF THE INVENTION

This invention relates generally to tools for removing coke from containers such as coking drums used in oil refining, and more particularly to an enhanced remotely operated cutting mode shifting apparatus for use with a combination decoking tool.

In conventional petroleum refining operations, crude oil is processed into gasoline, diesel fuel, kerosene, lubricants or the like. It is a common practice to recover heavy residual hydrocarbon byproducts through a thermal cracking process known as delayed coking. In a delayed coker operation, heavy hydrocarbon (oil) is heated to a high temperature (for example, between 900° F. and 1000° F.) in large fired heaters known as fractionation units. The heated oil releases its hydrocarbon vapors (including, among other things, gas, naphtha and gas oils) to the base of the fractionation unit for processing into useful products. The residual is then transferred to cylindrical vessels known as coke drums. These vessels, which are typically configured to operate in pairs, are as large as 30 feet in diameter and 140 feet in height. The combined effect of temperature and retention time leaves this residual, which is known as petroleum coke (or more simply, coke), in a solidified form. This coke residue must be broken up in order to remove it from the vessel, and is preferably accomplished by using a decoking (or coke cutting) tool in conjunction with a decoking fluid, such as high pressure water.

Such a tool includes a hydraulically-operated drill bit with both drilling and cutting nozzles that are configured to deliver a jet of fluid to the solidified coke. The bit is lowered into the vessel through an opening in the top of the vessel, and is formed into a common tool housing such that the high pressure water supply can be selectively routed through either the drilling or cutting nozzles, depending on the mode of operation. Since high flow rates and pressures (for example, flows of 1000 gallons per minute (gpm) at 3000 to 4000 pounds per square inch (psi)) are typically used for such operations, it is neither practical nor desirable to open drilling and cutting nozzles at the same time. Thus, to achieve this mode shifting, diverter valves or other flow control devices are used to direct the flow to the selected nozzles as required for the decoking operation. There are two commonly used diverter valve designs, both of which are complex, require numerous components, and require a very high level of precision in their manufacture in order to function properly.

One such valve is a reciprocatable sleeve-type valve having radial ports which selectively align with corresponding ports in the valve body to direct flow to either the drilling or cutting nozzles. The other is a rotatable sleeve, again having ports for selective alignment with corresponding ports of the valve body. In a more benign environment, both designs would provide adequate diversion control and operation. However, the water used in drilling and cutting operations is typically recycled repeatedly, collecting a quantity of suspended coke fines in the process. The passage of this water between seals, sleeves and related slidably-engaged adjacent tool components contributes to localized deposit of the fines. Such deposition can result in component jamming, especially between the sliding components of a reciprocating sleeve-type valve, thereby rendering the valve and the decoking tool inoperative. A similar result may also occur whether the valve is moved by springs, pneumatic or manual means. Once jammed, the tool must be removed, disassembled, and cleaned before decoking can be resumed. In fact, the overwhelming majority of failures in conventional autoshift tools are the result of coke fines entering the autoshift chamber and causing binding in the internal mechanism.

Another difficulty associated with these earlier designs is that they accomplished their mode shifting upon application of the cutting fluid pressure. Such operation is hard on the components, as the high levels of friction in the adjacent sliding or reciprocating components in such a high pressure environment made relative movement between such components more difficult. Furthermore, in situations involving the introduction of a high pressure fluid into a previously unpressurized (or underpressurized) flowpath, the possibility of a water hammer forming is enhanced. It is additionally problematic in that the already high levels of friction associated with the increasing pressure loads only increased the friction forces arising from the presence of the fines, thereby exacerbating the jamming tendency of the shuttling components.

A relatively trouble-free, manually shiftable, combination decoking tool was developed and described in U.S. Pat. No. 5,816,505, which is commonly owned by the Assignee of the present invention, and is incorporated herein by reference. The trouble-free nature of this tool is attributable to its mode shifting valve design which includes only a rotatable diverter plate for selectively directing cutting fluid to either pilot hole drilling nozzles or full-width coke cutting nozzles, thus eliminating most of the moving parts associated with other shifting mechanisms. Moreover, because of the simple rotatable flat diverter plate acting on a complementary flat diverter valve body, it also eliminated the multiple interfaces between parts which hitherto provided the jamming and associated failure sites of earlier designs of remotely operated shifting devices. In spite of these improvements, the tool still needed to be removed from the coke drum in order to change the cutting mode. To that end, an automated remotely operating decoking tool, described in U.S. Pat. No. 6,644,567, which is likewise commonly owned by the Assignee of the present invention and is incorporated herein by reference, was developed. The tool disclosed therein extends the operation of the tool disclosed in U.S. Pat. No. 5,816,505 by mounting a shifter body to the decoking tool that can rotate the tool's diverter plate upon release of the cutting fluid pressure from the tool. It would nevertheless be advantageous to extend the operability of the automated decoking tool disclosed in U.S. Pat. No. 6,644,567.

SUMMARY OF THE INVENTION

In one aspect of the present invention, this advantage is accomplished by providing a remotely operated mode shifting apparatus (also referred to herein as a shifting mechanism) for use with a decoking tool such that the tool can shift between a drilling mode and a cutting mode by rotation of a valving assembly. The apparatus is configured such that upon being connected to a decoking tool, the apparatus is rotatably and translationally responsive to changes in decoking fluid pressure to allow it to switch between drilling and cutting modes. One or more sets of tandem seals are disposed along the interfacial regions that may include a mechanical interface (such as between two or more shafts, journals, bearings or related joined components) or a fluid interface (such as between two or more components that are bathed in a common fluid environment) or other such location formed between components in the shifting mechanism that move relative to one another, as well as between one or more components of the shifting mechanism and the decoking tool that move relative to one another. In the present context, a tandem seal set is made up of two or more seals spaced apart from one another along the surface being sealed in such a way that the second (as well as any subsequent) seal act as a downstream backup to the first or other upstream seal that is exposed to the pressurized fluid. Likewise in the present context, such relative movement will be understood to include one or more of translational and rotational movement.

The use of such a tandem seal arrangement helps provide redundant isolation of seizure-sensitive components within the apparatus from highly pressurized decoking fluid and the entrained coke fines. In the present context, seizure-sensitive components are understood to be those components used in the mode shifting apparatus that are particularly prone to wear or binding that could lead to apparatus inoperability due to the presence of coke fines in the decoking fluid as discussed above. The inventors have determined that the tandem seals of the present invention are a particularly good way of avoiding the formation of back pressure buildup that may otherwise form to counteract any pressure driving a piston-actuated mechanism or related positive displacement drive motive device, as such a sealing arrangement provides redundancy to reduce the effects of leakage past a single set of lip seals (such as the type commonly used for reciprocating pistons and rotating shafts). The inventors have also determined that the benefits of the present tandem sealing arrangement are especially valuable in situations where the seals are exposed to intermittent pressurization or motion. Because the apparatus of the present invention involves some degree of reciprocal motion of a sealed member, the first of the two sets of seals is exposed to intermittent reciprocation. Likewise, the second of the two seal sets is exposed to intermittent rotation. By separating these two modes of relative movement, the seals can be made more robust than their single set counterparts that must be exposed to both types of movement. As such, the leakage associated with a single set of seals (especially as those seals wear over time) and the concomitant accumulation of incompressible liquid around the mechanical members within the apparatus that can lead to deterioration of performance due to an inability to accommodate the volume displacement of the reciprocating member (such as a piston, discussed in more detail below) due to back pressure can be reduced or avoided. More particularly, this feature of the present invention reduces or eliminates auxiliary connections through which contaminants could enter by using a vented redundant seal arrangement (often referred to as a "double block and bleed" arrangement) to avoid leakage of the pressurized cutting water into the autoshift chamber.

In optional forms, the decoking fluid flowpath used in the shifting mechanism includes a non-throughflow (or dead-ended) design such that a portion of the decoking fluid that is used to actuate the shifting mechanism enters and exits through the same opening or decoking fluid access port, where the entering is in a first direction and the exiting is in a second direction that is generally opposite of the first direction. In a more particular form, the adjacent components within the apparatus that are moveable relative to one another include at least a drive shaft and an actuating piston. The adjacent components between at least a portion of the shifting mechanism and the tool that are movable relative to one another may in a particular form be a drive shaft and at least one of the apparatus body and a support structure (such as a housing, body, flange or related component) making up a portion of the tool. The drive shaft and the actuating piston may be made selectively and spirally cooperative with one another such that upon changing between the first and second operating conditions, at least one of the drive shaft and the actuating piston moves in at least a translational manner while the other of the drive shaft and the actuating piston moves in at least a rotational manner. In a particular structural configuration, the shifting mechanism is made up of (among other things) a first drive (also referred to as an upper drive) that can be connected to a valve that is used to shift between the drilling and cutting modes of the tool, a second drive (also referred to as a lower drive) that is at least intermittently cooperative with the first drive, and numerous selectively engageable members cooperative with the actuating piston through the second drive such that in a first change of pressurization in the apparatus, one of these members rotates relative to the other, and in a second change of pressurization in the apparatus, both of the members are locked together such that neither rotates relative to each other. In this latter arrangement, the members and the second drive couple with the first drive to force a switch (through the valve) between the drilling and cutting modes in the tool. As will be discussed in more detail below, these selectively engageable members are preferably in the form of rings, which may include detents or related interlocking members. Detents on these selectively engageable rings may be keyed (for example, having one surface sloped and another surface with normal (i.e., perpendicular) facing arrangement between mutually-engageable surfaces) to permit them to be locked together in one rotational movement direction and rotationally decoupled from one another in an opposing rotational movement direction. The apparatus may further include an externally accessible manual override shaft that can be used to change between the drilling and cutting modes by manual adjustment of the shaft. In the present context, the manual override shaft may include a connection in the form of a nut, a milled shaft end, a slotted shaft end, or any other related rotatable extension that can be engaged with a tool and turned. The nut (or other clutching means) is specifically for protecting the internal mechanism against damage from being forced in the wrong direction.

In another option, a gas spring may be used to oppose a pressurizing force applied by the decoking fluid on the shifting mechanism. In its present form, the spring (not shown) is configured as a translatable piston resident in a complementary-shaped chamber filled with gas. In such configuration, the spring force is directly proportional to the gas pressure so that as the piston is depressed, the gas becomes compressed such that it increases the spring force. Such gas spring may include adjustable features to allow for a wider range of pressure-opposing options than a more fixed traditional spring (such as a coil spring or the like). For example, the amount of gas in the chamber can be introduced into or taken out of the chamber through a fill port (much in the same fashion as a basketball). This is valuable in that it allows for quick changes to the mode shifting apparatus in response to changes in the cutting pressure once the apparatus and tool are mounted in the field.

In yet another option, vent paths may be formed to allow pressure communication between an ambient environment and an interfacial region between the tandem seals. Such venting allows any pressurized decoking fluid that leaks through the uppermost seal or seals to be routed to the ambient environment rather than across the lowermost seal or seals. The vent paths work particularly well in conjunction with the tandem seals discussed above, as while the tandem seals reduce the likelihood of the pressurized decoking fluid or other liquid from reaching apparatus internals (such as an inner chamber), the vent paths allow pressure relief in the interstitial region between the seals via the unidirectional sealing action of lip seals in the event that such region were to become filled with liquid.

According to another aspect of the invention, a remotely operated mode shifting apparatus for selectively routing decoking fluid between a cutting nozzle and a drilling nozzle of a fluid jet decoking tool is disclosed. The apparatus includes a body that can be coupled to the decoking tool, a shifting mechanism and a gas spring configured to oppose a pressurizing force applied by the decoking fluid on the shifting mechanism. As with the previous aspect, the shifting mechanism is rotatably and translationally responsive to changes in pressure of a decoking fluid such that in a first operating condition, the apparatus is cooperative with the tool and the decoking fluid to establish a drilling mode with the drilling nozzle, while in a second operating condition, the apparatus is cooperative with the tool and the decoking fluid to establish a cutting mode with the cutting nozzle. The gas spring may be used as a restoring force, and in a more particular form, may be adjustable. In that way, the restoring force spring constant can be tailored to the decoking tool requirements, as well as to changes that may occur as the tool wears or is exposed to a different environment. In another form, the gas spring further includes a dampener such that the gas spring can be self-damping such that it can be used in place of conventional damping oil. Such damping in the spring can be controlled by orifices or related porting inside the spring, much in a manner similar to that in an automotive shock absorber.

Optionally, the apparatus may include one or more sets of tandem seals that can be used to redundantly isolate one or more seizure-sensitive components within the apparatus from the pressurized decoking fluid in the tool. In addition, a vent path can be formed between an ambient environment and a region fluidly disposed between the tandem seals. Together, the seals and the vent reduce the chance that pressurized fluid (as well as entrained coke fines or other contaminants) will work its way into the shifting mechanism.

According to still another aspect of the invention, a decoking tool is disclosed. The tool includes a housing that can be coupled to a drill stem or other source of decoking fluid. In addition, the tool includes one or more drilling nozzles and one or more cutting nozzles, as well as flowpaths to deliver pressurized fluid from a source that is fluidly coupled with the tool to the nozzles. The decoking tool also includes a remotely operated mode shifting apparatus that can shift between a drilling mode and a cutting mode. The apparatus is rotatably and translationally responsive to changes in decoking fluid pressure to allow the apparatus to switch between drilling and cutting modes. As discussed above, one or more sets of tandem seals are to promote an improved level of sealing between the pressurized fluid and the shifting apparatus. Such a configuration may, for example, help to reduce the likelihood of damage to the shifting apparatus be providing a redundant impediment to leakage of the pressurized fluid (and suspended coke fines or other particles) into the shifting apparatus.

Optionally, the means comprises a flow control device such that in a first operating condition, the flow control device fluidly couples the source of decoking fluid to the one or more drilling nozzles, while in a second operating condition, the flow control device fluidly couples the source of decoking fluid to the one or more cutting nozzles. In a more particular form, the flow control device is a valve, such as the aforementioned a diverter valve or related rotationally responsive valve. In another option, the decoking tool includes either or both a gas spring and an atmospheric vent similar to those discussed above in conjunction with a previous aspect of the invention. In a more particular form of the decoking tool, a diverter valve plate responsive to a control rod that in turn is manipulated by the apparatus in response to changes in decoking fluid pressure is included.

The diverter plate, through selective alignment of cutouts, ports or related valve componentry, includes access to conduit that routes the decoking fluid to one or the other of the drilling and cutting nozzles. In other forms, the apparatus includes more than one set of tandem seals where in an even more particular form, a first of the seal sets is placed at an interface between a rotatable drive shaft and a translational piston or related actuator that forms part of the apparatus, while a second of the seal sets is placed at an interface between the rotatable drive shaft and a stationary support structure that makes up part of either the shifting mechanism or the tool. In an even more particular form, the rotatable drive shaft is of a generally tubular, hollow structure such that other actuating equipment (for example, a piston or related pressure-responsive actuator) can be placed concentrically within the space defined within the drive shaft. In that way, the first of the tandem seal sets is disposed on an inner surface of the rotatable drive shaft, and a second of the tandem seal sets is disposed on an outer surface of the drive shaft. As such, both the inner and outer surfaces have a robust barrier that otherwise may expect to encounter potential pressurized decoking fluid leakage. A vent path may be formed between an ambient environment (such as the atmosphere) and a region fluidly disposed between the first and second seals of the tandem seal set. Likewise, a layer of sacrificial material may be placed between adjacently-facing components where the decoking fluid gets routed. Such a sacrificial layer can be used to avoid undue wear to a portion of the routing means or other such valve members.

According to yet another aspect of the invention, a method of operating a combination fluid jet decoking tool is disclosed. The method includes configuring the tool to cooperate with a mode shifting apparatus that is automatically responsive to changes in decoking fluid pressure. In this way, the apparatus controls which of a drilling nozzle flowpath and a cutting nozzle flowpath the decoking fluid flows through. The tool includes one or more of a gas spring and tandem seals. The method also include introducing the tool into a decoking vessel and providing the decoking fluid to the tool.

Optionally, the method further includes adjusting the spring constant of the gas spring. In another option, the method includes manually adjusting the apparatus through a manual override nut such that a combination of rotational and translational movement within the apparatus causes the apparatus to shift between a first operating condition where the apparatus is cooperative with the tool and the decoking fluid to establish a drilling mode and a second operating condition where the apparatus is cooperative with the tool and the decoking fluid to establish a cutting mode.

BRIEF DESCRIPTION OF THE DRAWINGS

The following detailed description of the present invention can be best understood when read in conjunction with the following drawings, where like structure is indicated with like reference numerals and in which.

DETAILED DESCRIPTION

Figure 1:
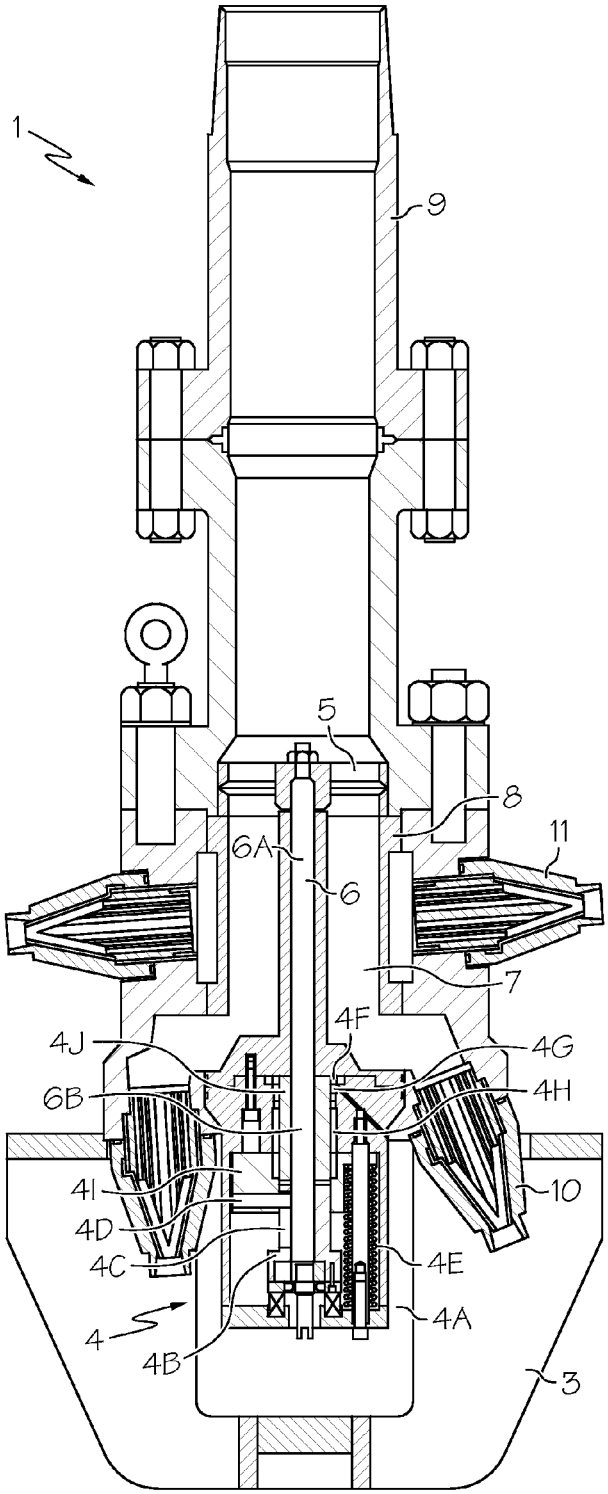
FIG. 1 (PRIOR ART)
FIG. 1 is a cutaway view of the combination coke cutting tool and mode shifting apparatus employing a rotatable diverter plate according to an aspect of the prior art.

Referring first to FIG. 1, a prior art decoking tool 1 with protective boring blades or vanes 3 and a mode shifting apparatus 4 installed in the tool 1 is shown. The mode shifting apparatus 4 is made up of numerous components, including a body 4A, actuator sleeve 4B, actuator slot 4C, actuator pin 4D, spring 4E, pressurized fluid inlet 4F, annular hydraulic cylinder 4G, annular piston 4H, actuator pin carrier 4I and a liner sleeve 4J that surrounds a lower portion 6B of a control rod 6 that also includes an upper portion 6A that can be joined together in a splined relationship. The control rod 6 is connected to a hydraulic distribution diversion plate (also called diverter plate) 5 such that when the mode shifting apparatus 4 is activated, either manually or by sequentially pressurizing and de-pressurizing operations from a fluid supply (not shown), the control rod 6 rotates the diverter plate 5, causing openings formed through the axial dimension thereof to alternately expose fluid delivery conduit 7 and either the drilling nozzles 10 or cutting nozzles 11 to a supply of high pressure fluid (for example, water) being delivered through an inlet pipe or drill stem 9. In the version depicted in FIG. 1, the drilling nozzles 10 are in fluid communication with the pressurized fluid supply in order to direct a generally downward stream of high pressure fluid into the coke (not shown), thereby boring a hole for the rest of the apparatus 4 to follow. The generally planar disk-like shape of the diverter plate 5, coupled with its rotatable mounting arrangement to control rod 6 permits shifting between a cutting mode and a drilling mode to occur by an intermittent clocking rotation of the diverter plate 5. The details of the construction and operation of diverter plate 5 will not be repeated herein, suffice to say that such details may be found in commonly-owned U.S. Pat. No. 6,644,567. It will be appreciated by those skilled in the art that the attributes of the present invention do not depend on the circular disk shape of the diverter plate 5, merely that the features disclosed herein may be used in cooperation with such a device as that of FIG. 1 to alternately seal off and expose the ports to have one or more be active while one or more other ones are inactive. Similarly, the sealing action does not have to be between two flat surfaces either, as local contact by a contoured surface of the diverter plate 5 or appendage thereof at the rim of the port would accomplish the same effect.

Because the decoking fluid is delivered under extremely high (for example, 5000 psig or more) pressure, it can impart a significant differential pressure across the diverter plate 5 at the locations where the plate 5 cuts off flow between the drill stem 9 and fluid delivery conduit 7. This results in forces as high as 40,000 lbf pressing the diverter plate 5 and a diverter body wear plate 8 together, which in turn generates a significant static friction that creates a tendency to resist relative rotation between them. In an automated form, such as that depicted in U.S. Pat. No. 6,644,567, the mode shifting apparatus 4 is designed to shift on de-pressurization because the friction (and concomitantly, the driving force needed to rotate the diverter plate 5) decreases over the discrete amount of time required to complete the rotation of the diversion plate 5 once it starts moving. This mode of shifting is preferable to shifting during pressurization, where the increasing pressure could raise the friction to a level that would make relative movement between adjacent components such as the diverter plate 5 and diverter body wear plate 8 difficult, as well as result in increased wear. It is additionally beneficial that the shifting takes place at low flow rates and pressure (typically under 500 psig), to avoid water hammer effects as the diverter plate 5 moves from one set of openings to the other. Despite this, there are still paths for the high pressure decoking fluid to leak into the mode shifting apparatus 4. For example, a generally horizontal slot formed between the diverter plate 5 and control rod 6 to facilitate ease of rotation between them is susceptible to the introduction of pressurized decoking fluid. Furthermore, a small annular gap exists between the control rod 6 and the remainder of the decoking tool body; this gap extends the length of the control rod 6 from its top (where the aforementioned gap is formed) to its bottom (where it joins with the mode shifting apparatus 4. Such a gap provides a leakage travel path from the horizontal slot above to the fluid inlet 4F and the annular hydraulic cylinder 4G. In addition, the annular construction of piston 4H is such that a reciprocating piston seal (not shown) is required to act on both an inner diameter and outer diameter sealing surface, thereby providing an increased opportunity for leakage and related failure.

Figure 2A:
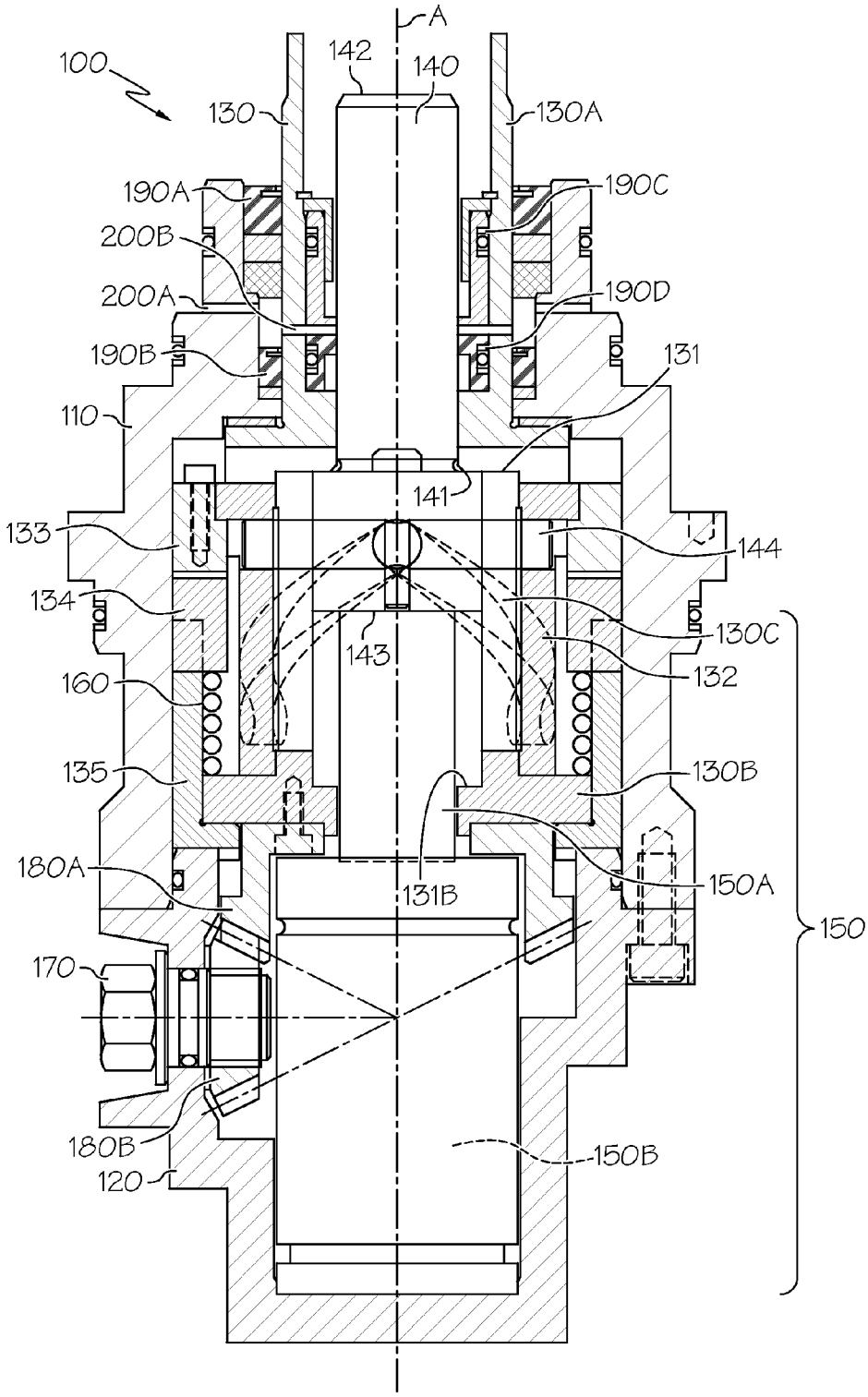
FIG. 2A is a detailed sectional view of a remotely operating cutting apparatus according to an aspect of the present invention in its rest state.
Figure 2B:
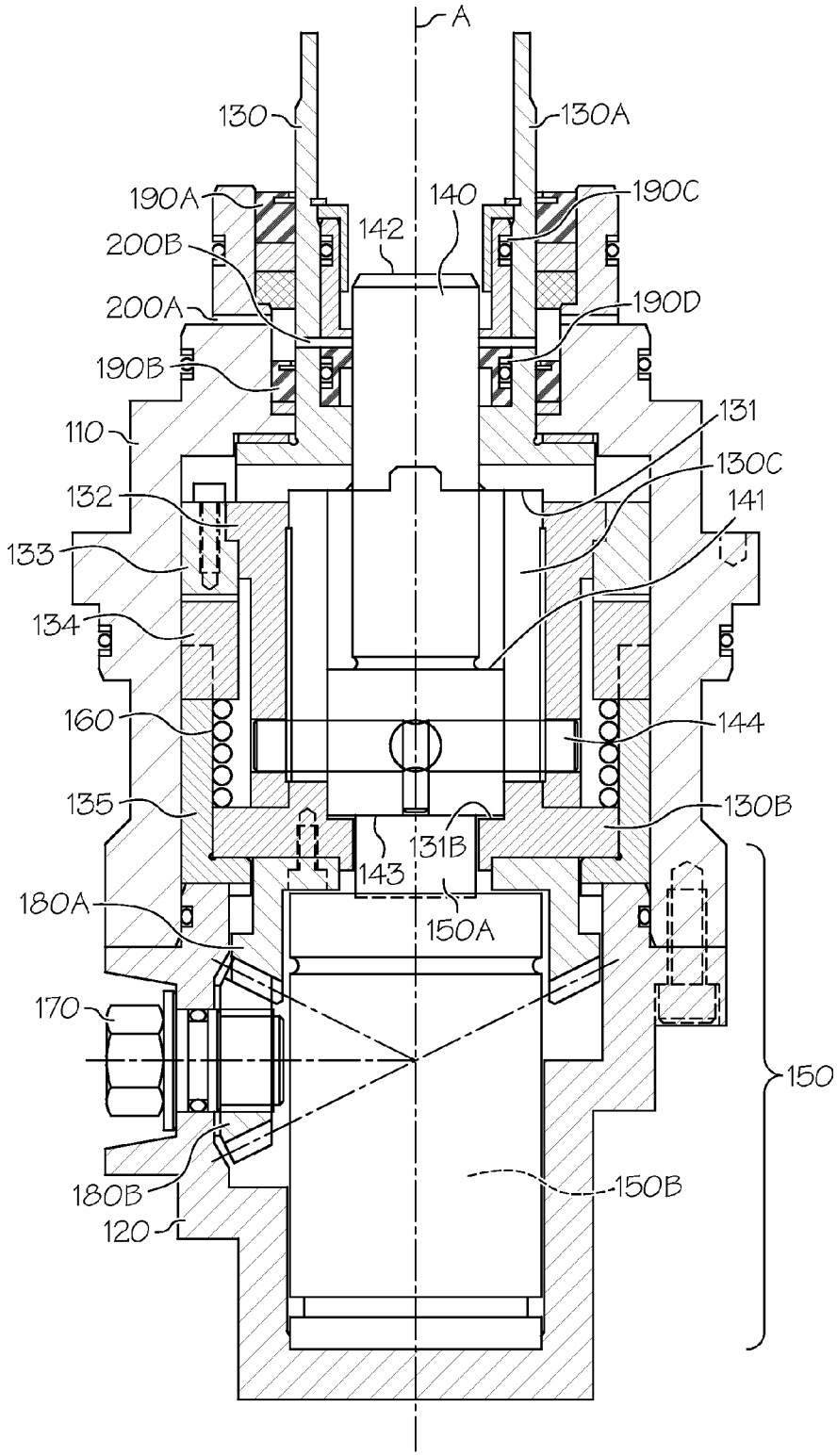
FIG. 2B is a detailed sectional view of a remotely operating cutting apparatus according to an aspect of the present invention in its energized state.
Figure 3:
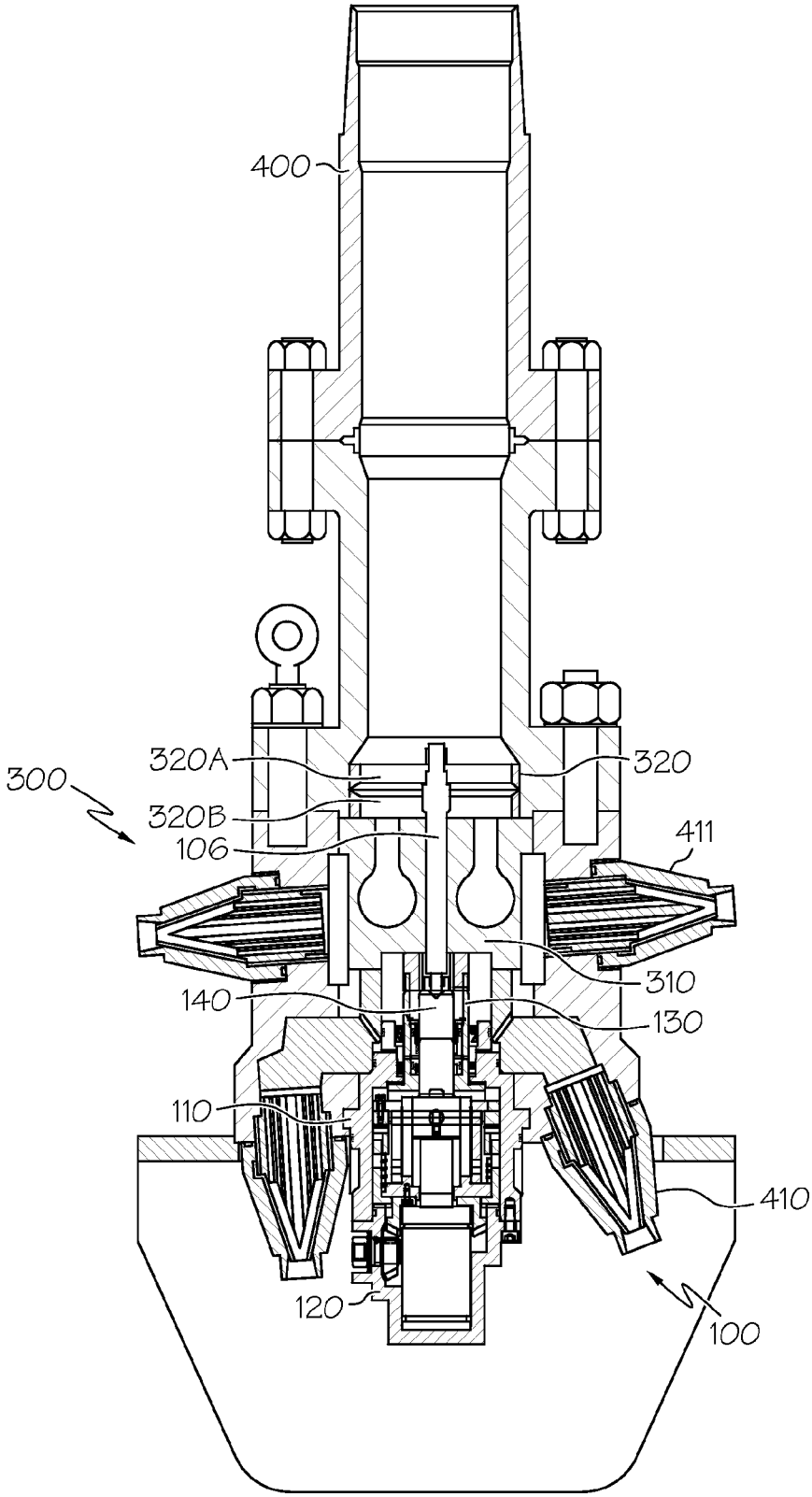
FIG. 3 is a schematic view of the remotely operating cutting apparatus integrated into a decoking tool.

Referring next to FIGS. 2A, 2B and 3, detailed sectional views of a mode shifting apparatus 100 according to an aspect of the present invention are shown. Unlike the annular piston 4H of the device in FIG. 1, a solid piston 140 is used. In the annular approach employed in FIG. 1, hydraulic cylinder 4G, annular piston 4H and actuator pin carrier 4I cooperate with liner sleeve 4J that is disposed around the lower control rod 6B and abuts the bottom of the decoking tool 1 adjacent the drilling nozzles 10 so that a gap is formed between the liner sleeve 4J and the surrounding apparatus body 4A to define the annular hydraulic cylinder 4G for receiving pressurized fluid and the subsequent driving of the piston 4H downward. Pressurization is accomplished through fluid inlet 4F that is formed in the top of the liner sleeve 4J. The annular piston 4H drives an actuator pin carrier 4I that is concentrically disposed about the liner sleeve 4J and lower control rod 6B and carries one or more radially-projecting actuator pins 4D. An actuator sleeve 4B is situated below the liner sleeve 4J and surrounded by the actuator pin carrier 4I. Actuator slot 4C receives the actuator pin 4D that cooperate together to accomplish the shift; these slots 4C lie on a spiral path of sleeve 4J, extending along the periphery of the sleeve 4J so that for each downward movement (as well as for each upward movement) of the actuator pin carrier 4I, the sleeve 4J rotates enough to ensure engagement of pawls or related mechanisms on an associated ratchet device. One or more springs 4E bias the actuator pin carrier 4I and annular piston 4H against the ports formed as part of the fluid inlet 4F so that throughflow is permitted. The spring force (or spring constant) is fixed by the properties of the spring 4E, including those due to material choice, wire gauge and coil turn rate. While the annular configuration of piston 4H of the previous device would make it difficult to achieve the redundant protection afforded by the tandem seals of the present invention, the solid shape of the present design means that only one reciprocating surface need be sealed.

The apparatus 100 is contained in a housing or body 110 and cover 120, and is attached to a decoking tool 300 to form the bottom portion thereof. In one form, a flange 310 or related mounting structure formed into a portion of the decoking tool 300 can serve as an interface between it and the apparatus 100. For example, such interface may be in the form of a sleeve bearing or related surface that provides rotational and related support for a rotatable drive shaft 130 that is used to actuate a diverter plate 320 that makes up a part of decoking tool 300 and is similar to diverter plate 5 of the device of FIG. 1. The decoking tool 300 is mounted to a drill stem 400 through which a supply of high pressure water or other decoking fluid is provided. The rotatable drive shaft 130 is made of an upper portion (also referred to as the upper drive) 130A and a lower portion (also referred to as the lower drive) 130B into which a straight, generally vertical slot 130C is formed. The generally tubular cylindrical shape of upper drive 130A (as shown with particularity in FIGS. 2A and 2B) engages a lower surface of flange 310 to can serve as an interface between the decoking tool 300 and the apparatus 100. For example, such interface may be in the form of a sleeve bearing. The upper drive 130A is centered in a close clearance area at the top of the diversion body so as to minimize any radial load contribution. As such, the connection provides support for a rotatable drive shaft 130 that is used to actuate a diverter plate 320 that operates in a manner generally similar to diverter plate 5 of the device of FIG. 1.

The drive shaft 130 extends through the apparatus 100 so that the top of the upper portion 130A is coupled to control rod 106 that drives the rotatable portion 320A of diverter plate 320, while both flange 310 and the non-rotatable (i.e., stationary wear plate) portion 320B of diverter plate 320 remain stationary. As with the connection to the decoking tool 300 discussed above, the rotatable drive shaft 130 can be disposed within a complementary surface in the housing 110, such as through a sleeve bearing or other well-known rotating connection. A reciprocating hydraulic actuator (in the particular form of a piston 140) is generally collinear with the rotatable drive shaft 130 and shuttles along a generally vertical axis A of the apparatus 100 in response to driving forces imparted to respective upper and lower surfaces 142 and 143 of piston 140 from the decoking fluid above and an adjustable gas spring 150 below. As discussed above, the decoking fluid being supplied is preferably pressurized water that can be used for both the drilling and cutting applications, as well as provide the driving force to shift the apparatus 100 between the drilling and cutting modes of operation. It will be appreciated by those skilled in the art that other components (such as some those discussed below) can be used in conjunction with the piston 140 to make up an actuator for the purpose of effecting the diverter plate valving and related mode shifting. Gas spring 150 is shown in its extended state in FIG. 2A and in its compressed state in FIG. 2B, and includes a piston 150A (which can be shaped in a manner generally similar to that of piston 140 discussed above) fitted within or otherwise cooperative with a gas-isolatable chamber 150B (shown occupying the space in the lower portion of housing 110).

Details of the components that cooperate to facilitate mode shifting are described next. In general, the mode shifting components permit the apparatus 100 to exist in one of two states that depend on which of the two driving forces (i.e., the decoking fluid or the spring 150) acting on piston 140 predominate. In operating conditions where the force due to the decoking fluid is greater, the piston 140 is situated in a vertically downward position and a flowpath is established through the diverter plate 320 for either the cutting or drilling nozzles of the decoking tool 300. Likewise, in operating conditions where the force due to the spring 150 is greater (such as where the supply of pressurized decoking fluid is shut off), the piston 140 is situated in a vertically upward position, and by a ratcheting or clocking rotational movement of the diverter plate 320, shifts the flowpath coupling from one of the cutting and drilling modes to the other. This ratcheting movement takes place predominantly in drive shaft 130 (which includes upper drive 130A, lower drive 130B and vertical slots 130C that are formed in an upward extension of the lower drive 130B), as well as though reciprocating and intermittent rotational movement of the piston 140. As mentioned above, the spring force of the spring 150 can be adjusted, such as through a user-determined introduction of pressurized gas, such as nitrogen or other suitable fluid. Moreover, its operation can reduce or eliminate the need for damping oil.

The drive shaft 130 and hydraulic piston 140 are in cooperative arrangement with one another through one or more pins 144 cooperative with or formed in the lower end of the hydraulic piston 140, where the vertical slots 130C that are formed in lower drive 130B accept the pins 144. In addition, a pair of rings 133 and 134, the first of which engages in strictly rotational movement and the second of which engages in strictly translational movement, are employed to assist in the aforementioned intermittent rotational movement of the piston 140 when pin 144, under the upward biasing due to spring 150, traverses a generally spiral path 144A (shown with particularity in FIG. 2A) formed in an actuator cam 132 that is disposed concentrically around lower drive 130B and vertical slots 130C. The rotating ring 133 is keyed to the top of cam 132 as well as the generally vertical slots 130C that form part of the lower drive 130B. Directly below the rotating ring 133 is a stationary ring 134 that is constrained from rotating by vertical tabs of a retainer 135 that is secured to the housing 110. The connection of the pin 144, piston 140 and complementary slots 130C, actuator cam 132 and rings 133 and 134 is such that a scissors-like motion is created.

Figure 4:
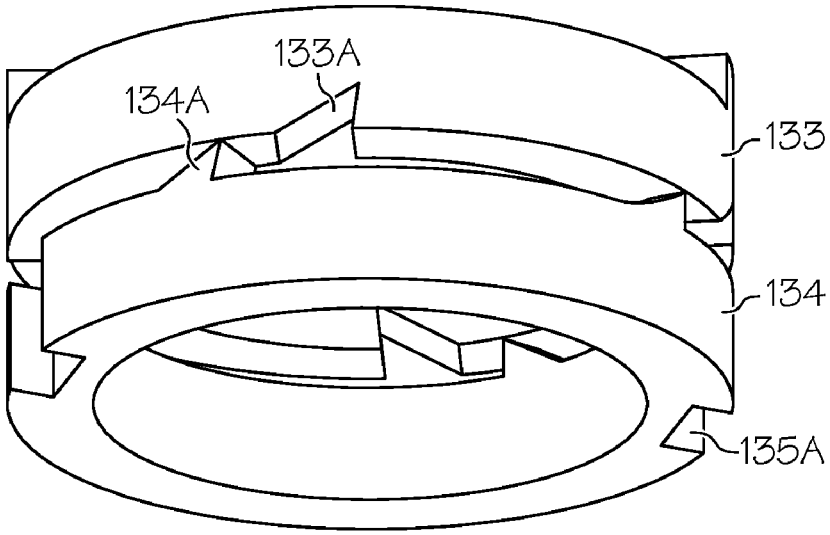
FIGS. 4 and 5 are schematic views of the ratchet portion in its disengaged and engaged positions, respectively.
Figure 5:
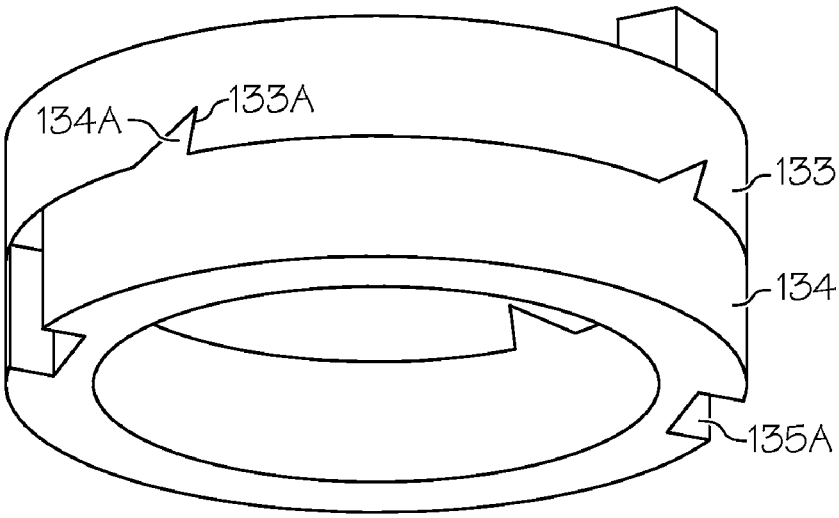

Referring next to FIGS. 4 and 5, a pair of one-way rings 133 and 134 are used to promote the selective ratcheting movement of the drive shaft 130 and attached diverter plate 320. The cooperation between the rotating ring 133 and the stationary ring 134 is shown, where they engage each other through up to four ramped axial teeth 134A in the stationary ring and matching slots 133A in the rotating ring. The connection of the cam 132 to the rotating ring 133 is such that when the cam 132 rotates (due to the force of pin 144 during the downward travel of the piston 140), it forces the ring 133 to follow, which because of the inclined engagement of contacting surfaces between the teeth 134A and slots 133A, facilitates disengagement of the rotating ring 133 from the stationary ring 134 (which is constrained from rotational movement by the vertically upward projection from retainer 135) and turn in one direction only. Upon engagement of the teeth 134A and slots 133A, they prevent rotation of the rotating ring 133 in the opposite direction. Spring mechanism 160 (which is shown in FIGS. 2A and 2B), presses vertically upwards on the stationary ring 134 to engage the teeth 134A in the slots 133A. The slope of the surfaces of disengagement of the teeth 134A and slots 133, along with the strength of the spring mechanism 160 determine the torque required to disengage the rotating and stationary rings 133, 134. The present arrangement provides a snap action to this portion of the mechanism when the teeth 134A reengage; such action provides additional indicia of a secure fit between the rotating and stationary rings 133, 134. The surfaces of engagement of the teeth 134A and slots 133A have a locking angle to ensure they remain engaged when torque is applied to the rotating ring 133 in the opposite direction. Generally vertical slots 134B formed at diametrically-opposed outer surfaces of the stationary ring 134 are used to accept an upper projection of retainer 135, while a flexural spring 160 that is supported on its lower end by lower drive 130B exerts a bias against a lower surface of stationary ring 134. Flexural spring 160, while shown notionally as a coil in FIGS. 2A and 2B, is more preferably in the form of a multiple Belleville spring to take better advantage of the limited spatial environment in which it works.

Referring again to FIGS. 2A, 2B and 3, during decoking operations, respective cutting or drilling cutouts formed in the two axially-alignable plates 320A, 320B of diverter plate 320 can be made to cooperate with one another by rotating plate 320A to allow the passage of the high pressure decoking fluid from the drill stem 400 to the appropriate set of nozzles 410 or 411. In this situation, the static pressure formed on the diverter plate 320 from the decoking fluid from above restrains it from rotating solely by friction due to the unbalanced force acting on the rotatable portion 320A of diverter plate 320. This unbalanced force is due to one set of the ports formed in the rotatable portion 320A of diverter plate 320 being blanked off, as pressure formed on the upper side where the diverter plate 320 covers the set of ports, as well as atmospheric pressure on the blanked off port side of the diverter plate 320, acts to provide the necessary friction. The active ports are pressurized due to the back pressure resulting from flow through the active nozzles set of nozzles 410 or 411 whereas the inactive ports are vented to atmosphere through the inactive set of nozzles 410 or 411. As such, it is the relative friction between these components that controls the action of the mechanism so that during pressurization, this friction constrains the rotatable portion 320A of diverter plate 320, the control rod 106 and drive shaft 130 from rotating.

The pressure on the tool 100 from the decoking fluid acts on the upper end 142 of the piston 140, creating a downward force that, when it reaches a level where it exceeds the preload in the gas spring 150, causes the hydraulic piston 140 to translate downwards. The one or more pins 144 move vertically downward in the path defined by the slot 130C, which is held stationary by the friction at the diverter plate 320 as discussed above, and acting on the spiral slot of cam 132, forcing the cam 132 to rotate. Likewise, the connection of the rings 133 and 134 as shown in FIG. 5 forces the two rings 133, 134 to rotate relative to one another. Such translational movement of the piston 140 and rotational movement of the cam 132 and ring 133 continues until such time as the lower surface 143 of the piston 140 comes to rest on a shoulder 131B in the lower drive 130B. In one preferable form, the lower plate 320B acts as a wear plate facingly adjacent the upper plate 320A. As can be seen by particular reference to FIG. 3, the wear plate 320B acts as a stationary appendage at the upper end of the flange 310 and is configured as a sacrificial surface that can be periodically renewed by resurfacing or replacement when worn, thereby avoiding the need to repair or replace the more intricate flange 310. During pressurization of the tool 300, the piston 140 starts to move downward once it overcomes the preload in spring 150. During this downward movement, ring 133 is able to rotate relative to ring 134 due to pin 144 acting on the spiral slot in the actuating cam 132 and straight slot 130C in the lower drive 130B. At this point, friction in diverter plate 320 prevents the drive 130 from rotating because the torque required to turn ring 133 relative to ring 134 is not sufficient to overcome the friction between the stationary wear plate 320B and the rotating upper plate 320A. This causes slot 130C to remain stationary, forcing the actuating cam 132 to rotate relative to drive 130B. The downward travel of piston 140 is arrested as described above, ensuring rings 133 and 134 stop in the correct index position relative to each other and limiting the degree of compression on spring 150.

Referring with particularity to FIG. 2B, when pressure is removed from the apparatus 100 (such as when the flow of decoking fluid is reduced or removed from the drill stem 400), the spring 150 forces the piston 140 upward. Unlike the downward movement discussed above, the rings 133 and 134, by virtue of the overlapping normal contact of the teeth 134A and slots 133A and related resistance to disengagement between them when the rings move in a reverse rotational direction relative to one another, remain coupled together. Thus, the two rings 133 and 134, which are now coupled directly to both the retainer 135 and the cam 132, remain rotationally stationary during the upward movement of the piston 140. The pins 144 again are forced to follow a path set out for them, but his time, the path is determined by the generally spiral path 144A formed in the now-stationary actuator cam 132 which is constrained against rotation induced by pin 144 in the upward direction due to the locking action between rings 133 and 134. This movement continues until the piston's shoulder 141 comes in contact with a lower shoulder 131 of the upper drive 130A, limiting the piston's upward travel. In addition, the drive shaft 130 now rotates, as its coupling through the vertical slots 130C also forces to follow the spiral path of the pins 144. Lower drive 130B is initially constrained against rotation because the torque induced by pin 144 acting against track 130C is insufficient to overcome the counterbalancing pressure induced friction at the diverter plate 320. As the pressure in tool 300 further decays, the net upward force induced in pin 144 increases due to a reduction in the piston 140 force counterbalancing the force from spring 150. Simultaneously, the resistive friction at the diverter plate 320 reduces with decaying pressure. When the increase in shaft torque induced by pin 144 reaches a level where it can overcome the reduced friction at diverter plate 320, shifting motion commences. Since this shifting action starts to take place during decaying pressure and while the force due to friction at diverter plate 320 drops once it starts rotating, the pressure at which the shift mode changes is consistent, and therefore repeatable and well-defined. Furthermore, as discussed above, this is made adjustable by altering the charge pressure of spring 150. The charge pressure of gas spring 150 affects the amount of water pressure (also known as the setup pressure) that is required to compress the spring 150, thereby allowing the mechanism to start to shift.

Spring 150 as discussed above may additionally include damping features that are used to control the rate at which the mechanism moves. As mentioned above, such features can be in the form of a shock absorber integrated into the gas spring 150. Generally, the damping is kept high enough that changes in the gas spring charging pressure have only a minor effect on the rate of shifting. Although not shown, the chamber 150B that forms isolatable container with which to hold the pressurizable gas may include features similar to that of an automotive shock absorber, including an inner cylindrical region and an outer cylindrical region connected by one or more internal orifices that can be arranged to control the rate of movement of the gas within the spring. The pressurizable gas (also called a charging medium) may be any conventional (and preferably inert) gas, such as nitrogen. In one form, this gas can be pressurized to a degree necessary to provide adequate damping for apparatus 100, such as between approximately 200 pounds per square inch and approximately 1500 pounds per square inch such that it produces a maximum piston 150A travel speed of approximately 20 inches per second that exhibits a precipitous and early drop in travel velocity versus travel distance. Furthermore, the present inventors have determined that the mode shifting apparatus 4 could include torque adjustment to optimize the shifting pressure.

An important point of this damping feature is that it provides a self contained, maintenance-free way to control the rate of movement within the apparatus 100. Because the mode shift takes place on decreasing pressure, there is no significant friction at the diverter plate 320 at the interface between stationary and rotating plates 320A and 320B to act as a brake once the rotation between them is set into motion. Such lack of frictional resistance means that the apparatus 100 may have a tendency to overrun the correct index position for the next operating mode. Prior attempts at avoiding this situation through mechanical means were unavailing, as they had a tendency to introduce high component stresses, and were otherwise not effective at arresting the momentum associated with diverter plate rotation. The use of the presently-disclosed damping features to limit the acceleration and momentum of the apparatus 100 improves the ability to control its stopping position. The weakness of damping in the pre-existing design is that it uses a liquid in the damping mechanism's chamber; such liquid is susceptible to being lost (through leakage), over-filling, or contamination from leakage of the cutting fluid through the seals. This in turn necessitated the use of external ports to facilitate maintenance and level control. The very existence of these external ports has proved to be a potential for failure due one or both of contamination from the external environment and poorly executed maintenance.

In situations where a manual mode change of the apparatus 100 is desired, the tool 100 also can be manually shifted by placing a wrench on an override connection (shown in the form of a shaft) 170 that is situated on an upper portion of the cover 120 and turning it with an appropriate tool. This, in turn, drives a set of bevel gears 180A and 180B, one of which is attached to the lower drive 130B. The snap-action of the spring loaded rings 133, 134 discussed above provides the operator a sense of feel for when the tool 100 reaches its next clocked position. The override connection 170 has an indicator mark on it to visually show the position of apparatus 100. Further, the override connection 170 has a unidirectional clutch to limit the torque that can be applied in the opposite direction of rotation during override. Such unidirectional clutch could be a nut between the override connection 170 and the tool used to turn it. In addition, the mechanism is locked during override by the stepped interface between rings 133 and 134 against reverse rotation. Turning the drive connection 170 backwards results in it unthreading rather than damaging the internal mechanism of the apparatus 100.

Note that the piston 140 and drive shafts 130A, 130B rotate together as the tool 100 shifts. Therefore, the motion of the piston 140 relative to the drive shaft 130 is strictly reciprocating whereas the motion of drive shaft 130 relative to the body 110 is strictly rotating. The primary output of the mode shifting apparatus 100 is a ninety degree increment of rotary motion through the output drive 130, which in turn is used to turn diverter plate in a manner generally similar to that of U.S. Pat. Nos. 5,816,505 or 6,644,567. As with those designs, the "dead end" design expels all of the pressurized fluid through the same ports through which the fluid entered, providing a cleaning action which reduces the likelihood that coke fines will accumulate and jam the shifting mechanisms of the tool 100. As such, with each depressurization of the tool 100, all the cutting fluid, together with suspended coke fines, that is admitted to the annular cylinder in the previous pressurization is expelled from the cylinder through its entrance ports with no flow-through.

One attribute of the apparatus 100 is that it includes a non-throughflow (i.e., dead-ended) design that ensures that all of the decoking fluid and the coke fines suspended therein that are used to effect the shifting between the two modes are expelled from the hydraulic cylinder through the same path that the fluid was admitted, thereby preventing accumulation of the fines in the apparatus 100 and the concomitant likelihood of component jamming and related failure due to the suspended fines or other contaminants.

In addition to the dead-ended design, the apparatus 100 includes a first pair of tandem seals 190A and 190B along an outer surface of rotatable drive shaft 130 that contacts body 110 of apparatus 100, and a second pair of tandem seals 190C and 190D that cooperate with an inner surface of rotatable drive shaft 130 and the outer surface of piston 140. The uppermost seals 190A and 190C of each seal pair seals against the pressure of the decoking fluid that is introduced into the apparatus 100 from the decoking tool, whereas the lowermost seals 190B and 190D of each seal pair reduces the likelihood that any pressurized fluid that leaks past the uppermost seals 190A and 190C will reach the inner area of the body 110. Seals 190A and 190C are situated vertically above seals 190B and 190D, while seals 190A and 190B are situated radially outward relative to seals 190C and 190D. Between each pair of seals (for example, between upper seal 190C and lower seal 190D) are a series of radially-extending vent holes 200A, 200B to allow the space between the seals to be vented to the atmosphere. In this way, any leakage formed between the tandem seals (whether between the primary outer seal 190A and the secondary outer seal 190B or between the primary inner seal 190C and the secondary inner seal 190D) will not result in a concomitant pressure buildup, as the preferential path for any such buildup will be through vent holes 200A and 200B. Hence the first seals 190A, 190C of each pair seals against the pressure of decoking fluid, whereas the second seals 190B, 190D of each pair ensures that any leakage getting past the first seals 190A, 190C cannot enter the inner area of the body 110 of the apparatus 100. The tandem seal feature, in conjunction with the use of the gas dampener features of spring 150 avoids unnecessary exposure of the components to the harsh coke cutting environment. As is apparent from the manner of operation of the apparatus 100, the piston 140 reciprocates relative to the drive shaft 130 during the downward stroke of piston 140 such that there is purely translational relative to the upper drive 130A of drive shaft 130. As such, the second pair of tandem seals 190C and 190D act to reduce or eliminate leakage of the decoking fluid across the bearing surface or related interface between the piston 140 and the drive shaft 130.

The above discussions put emphasis on the tool failing due to pressurized cutting water being present in the shifting mechanism chamber. It is true that having a back pressure on the piston will reduce the force developed, and hence become a performance issue. Pressure aside, however, the presence of an incompressible fluid at the backside of the piston can be an issue, as the piston requires displacement volume to function properly. In the event that an incompressible liquid ever completely filled the shifting mechanism chamber, it could prevent the piston from developing full travel. In prior art configurations, a conventional relief valve was employed to avoid such a scenario. The exposure of such a valve to the outside environment could contribute to a high likelihood of failure, thereby allowing contaminants from the external environment (which may include includes expended cutting water and tailings from the cutting operation) to enter the shifting mechanism chamber and increase the chances of even more severe contamination and seizing of the mechanism than the cutting water alone. The tandem seals 190A-190D (which are all in the form of lip seals) can reduce the chances of this happening through the use of the vented interspace region between radially-extending vent holes 200A, 200B that prevents cutting water from reaching the second (i.e., downstream) seal (for example, one or both of seals 190B and 190D) under pressure and leaking into other parts of the apparatus 100. Likewise, this vented interspace (or interstitial) region prevents an undue pressure buildup. Moreover, the vented interspace allows the second lip seal to act as an integral relief valve for the apparatus 100 due to its unidirectional sealing properties. In the present context, 190A and 190C are considered primary seals, while 190B and 190D are considered secondary seals. The venting site is in a much more protected environment and the manner in which lip seals relieve downstream fluid does not make it prone to allowing solids to migrate into the inner chamber portion of the apparatus 100 during venting.

While certain representative embodiments and details have been shown for purposes of illustrating the invention, it will be apparent to those skilled in the art that various changes may be made without departing from the scope of the invention, which is defined in the appended claims.

What is claimed is:

1. A remotely operated mode shifting apparatus for selectively routing decoking fluid between a cutting nozzle and a drilling nozzle of a fluid jet decoking tool, said apparatus comprising:

a body configured to be coupled to said decoking tool;

a shifting mechanism disposed in said body and rotatably and translationally responsive to changes in pressure of a decoking fluid such that in a first operating condition, said apparatus is cooperative with said decoking tool to establish a drilling mode with said drilling nozzle, while in a second operating condition, said apparatus is cooperative with said decoking tool to establish a cutting mode with said cutting nozzle; and at least one set of tandem seals disposed along an interface formed by at least one of (a) adjacent components within said apparatus that are moveable relative to one another and (b) adjacent components between at least a portion of said shifting mechanism and said decoking tool that are movable relative to one another, said at least one set of tandem seals and said interface cooperative such that at least one seizure-sensitive component within said apparatus is redundantly isolated from a pressurized decoking fluid in said decoking tool.

2. The apparatus of claim 1, wherein said at least one set of tandem seals comprises a plurality of sets.

3. The apparatus of claim 2, wherein a first of said plurality of sets is disposed at an interface between a rotatable drive shaft and a translational actuator within said apparatus, and a second of said plurality of sets is disposed at an interface between said rotatable drive shaft and a stationary support structure formed on at least one of shifting mechanism and said decoking tool.

4. The apparatus of claim 3, wherein said first of said plurality of sets is disposed on an inner surface of said rotatable drive shaft, and a second of said plurality of sets is disposed on an outer surface of said rotatable drive shaft.

5. The apparatus of claim 2, further comprising a vent path formed between an ambient environment and a region fluidly disposed between a first seal and a second seal of said at least one set of tandem seals.

6. The apparatus of claim 1, further comprising a gas spring configured to translationally oppose a force applied by said pressurized decoking fluid on said shifting mechanism.

7. The apparatus of claim 6, wherein said gas spring comprises:

a pressurizable gas contained within an isolatable chamber within said body; and a piston cooperative with said pressurizable gas and substantially aligned along a direction of translational movement of a portion of said decoking tool operated upon by said pressurized decoking fluid such that when a force due to a spring constant commensurate with said gas spring is sufficient to overcome a force imposed on said portion of said decoking tool, said apparatus causes said portion of said decoking tool to move as part of a mode shift.

8. The apparatus of claim 7, wherein said gas spring comprises a selectively sealable gas introduction port to allow adjustment to said spring constant through changes in the pressure of said pressurizable gas.

9. The apparatus of claim 6, wherein said gas spring comprises a shock absorbing mechanism formed therein.

10. The apparatus of claim 1, wherein a decoking fluid flowpath used in said shifting mechanism comprises a non-throughflow design such that a portion of the decoking fluid that is used to actuate said shifting mechanism enters upon pressurization through a decoking fluid access port in a first direction and then upon depressurization exits through said decoking fluid access port in a second direction that is generally opposite of said first direction.

11. The apparatus of claim 1, wherein said adjacent components within said apparatus that are moveable relative to one another comprise at least a drive shaft and an actuating piston, and said adjacent components between at least a portion of said shifting mechanism and said decoking tool that are movable relative to one another comprise said drive shaft and at least one of said body and a support structure making up a portion of said decoking tool.

12. The apparatus of claim 11, wherein said drive shaft and said actuating piston are selectively and spirally cooperative with one another such that upon changing between said first and second operating conditions, at least one of said drive shaft and said actuating piston moves in at least a translational manner while the other of said drive shaft and said actuating piston moves in at least a rotational manner.

13. The apparatus of claim 11, wherein said shifting mechanism comprises:

a first drive configured to actuate a valve in said decoking tool;

a second drive at least intermittently cooperative with said first drive; and a plurality of selectively engageable members cooperative with said actuating piston through said second drive such that in a first change of pressurization in said apparatus, one of said members rotates relative to the other, and in a second change of pressurization in said apparatus, both of said members are locked together such that neither rotates such that said members and said second drive couple with said first drive in order to change between said drilling and cutting modes in said decoking tool.

14. The apparatus of claim 13, wherein said plurality of selectively engageable members comprise a first ring and a second ring, wherein said first ring rotates relative to said second ring during pressurization of said shifting mechanism and does not rotate relative to said second ring during depressurization of said shifting mechanism.

15. The apparatus of claim 1, further comprising a manual override nut cooperative with said shifting mechanism such that rotational movement of a component therein with which to change between said drilling and cutting modes can be effected thereby.

16. The apparatus of claim 1, further comprising an override connection rotatably coupled to said shifting mechanism.

17. A remotely operated mode shifting apparatus for selectively routing decoking fluid between a cutting nozzle and a drilling nozzle of a fluid jet decoking tool, said apparatus comprising:

a body configured to be coupled to said decoking tool;

a shifting mechanism rotatably and translationally responsive to changes in pressure of a decoking fluid such that in a first operating condition, said apparatus is cooperative with said decoking tool and said decoking fluid to establish a drilling mode with said drilling nozzle, while in a second operating condition, said apparatus is cooperative with said decoking tool and the decoking fluid to establish a cutting mode with said cutting nozzle; and a gas spring configured to oppose a pressurizing force applied by the decoking fluid on said shifting mechanism.

18. The apparatus of claim 17, wherein said shifting mechanism further comprises:

at least one set of tandem seals disposed along an interface formed by at least one of (a) adjacent components within said apparatus that are moveable relative to one another and (b) adjacent components between at least a portion of said shifting mechanism and said decoking tool that are movable relative to one another, said at least one set of tandem seals and said interface cooperative such that at least one seizure-sensitive component within said apparatus is redundantly isolated from a region in said decoking tool that contains pressurized decoking fluid; and a vent path formed between an ambient environment and a region fluidly disposed between a first seal and a second seal of said at least one set of tandem seals.

19. A decoking tool comprising:

a housing configured to be coupled to a source of decoking fluid;

at least one drilling nozzle and at least one cutting nozzle;

means for selectively routing decoking fluid through said housing and to one of said at least one cutting and drilling nozzles;

a drive unit configured to operate upon said selective routing means; and a mode shifting apparatus for controlling said means through said drive unit, said mode shifting apparatus rotatably and translationally responsive to changes in pressure of the decoking fluid such that in a first operating condition, said decoking tool establishes a drilling mode with said at least one drilling nozzle, while in a second operating condition, said decoking tool establish a cutting mode with said cutting nozzle, said mode shifting apparatus comprising at least one set of tandem seals disposed therein that cooperate to provide redundant isolation of seizure-sensitive components within said mode shifting apparatus from a region in said decoking tool that contains pressurized decoking fluid.

20. The decoking tool of claim 19, wherein said selectively routing means comprises a flow control device such that in a first operating condition, said flow control device fluidly couples the source of decoking fluid to said at least one drilling nozzle, while in a second operating condition, said flow control device fluidly couples the source of decoking fluid to said at least one cutting nozzle.

21. The decoking tool of claim 20, wherein said flow control device comprises a diverter valve.

22. The decoking tool of claim 19, further comprising a gas spring cooperative with said apparatus to oppose a pressurizing force applied by the decoking fluid on said apparatus.

23. The decoking tool of claim 19, further comprising a layer of sacrificial material disposed between said mode shifting apparatus and said routing means.

* * * * *

UNITED STATES PATENT AND TRADEMARK OFFICE

CERTIFICATE OF CORRECTION

PATENT NO. : 8,398,825 B2
APPLICATION NO. : 12/772410
DATED : March 19, 2013
INVENTOR(S) : Douglas Adams et al.

It is certified that error appears in the above-identified patent and that said Letters Patent is hereby corrected as shown below:

In the Specification:

Col. 6, Line 46, "The method also include" should read --The method also includes--;

Col. 8, Line 21, "apparatus 4." should read --apparatus 4).--;

Col. 9, Line 15, "to can serve" should read --to serve--;

Col. 9, Lines 44-45, "some those" should read --some of those--;

Col. 12, Line 15, "but his time" should read --but this time--;

Col. 13, Line 27, "due one or both" should read --due to one or both--;

Col. 14, Line 64, "(which may include includes expended)" should read --(which may include expended)--; and In the Claims:

Col. 18, Line 16, "establish" should read --establishes--.

Signed and Sealed this
Twenty-fourth Day of September, 2013

Teresa Stanek Rea

Teresa Stanek Rea
*Deputy Director of the United States Patent and Trademark Office*